United States Patent [19]

Terrell

[11] Patent Number: 4,489,836

[45] Date of Patent: Dec. 25, 1984

[54] SUSPENSION FILING MEANS

[75] Inventor: Christopher E. Terrell, London, England

[73] Assignee: MC2 Ltd., London, England

[21] Appl. No.: 338,869

[22] Filed: Jan. 12, 1982

[30] Foreign Application Priority Data

Jan. 13, 1981 [GB] United Kingdom ..... 8100937
Jun. 24, 1981 [GB] United Kingdom ..... 8119512

[51] Int. Cl.[3] ..... A47F 5/00

[52] U.S. Cl. ..... 211/45; 24/346; 211/46; 312/184

[58] Field of Search ..... 211/46, 40, 45, 7, 124, 211/113, 119; 248/339, 305, 340, 303, 316.8, 316.9; 312/183, 184; 24/346, 347, 343, 344, 345

[56] References Cited

U.S. PATENT DOCUMENTS

| | | | |
|---|---|---|---|
| 641,544 | 1/1900 | Richards | 24/343 |
| 2,802,250 | 8/1957 | Klotz | 248/316.9 |
| 3,350,754 | 11/1967 | Ballenger et al. | 24/344 X |
| 3,524,688 | 8/1970 | Dean | 312/184 |
| 3,806,995 | 4/1974 | Gass | 24/346 |
| 4,055,874 | 11/1977 | Brown . | |
| 4,232,918 | 11/1980 | Leber | 211/46 X |
| 4,262,808 | 4/1981 | Laporte | 312/184 X |

FOREIGN PATENT DOCUMENTS

| | | | |
|---|---|---|---|
| 1025419 | 1/1978 | Canada | 24/343 |
| 261317 | 11/1926 | United Kingdom . | |
| 283016 | 1/1928 | United Kingdom . | |
| 403288 | 5/1933 | United Kingdom . | |
| 757030 | 9/1956 | United Kingdom . | |
| 899821 | 6/1962 | United Kingdom . | |
| 993809 | 6/1965 | United Kingdom . | |
| 1087888 | 10/1967 | United Kingdom . | |
| 1103587 | 2/1968 | United Kingdom . | |
| 1322350 | 7/1973 | United Kingdom . | |

*Primary Examiner*—Robert W. Gibson, Jr.
*Attorney, Agent, or Firm*—Murray Schaffer

[57] ABSTRACT

A suspension clip, particularly for the suspension filing of open-topped envelopes containing floppy discs for computers, comprises a hook member of U-shape having a transverse part from which extend two arms, one of which has on its outside a longitudinally extending groove, and a resiliently deflectable prong which is anchored at or adjacent said transverse part and extends along said groove. Thus, two clips can be used to suspend an envelope from two parallel rails of a suspension filing system.

A suspension filing system which may be used with said clips comprises at least one rail for engagement by a clip, a retaining bar disposed above the level of and adjacent to and substantially parallel to said rail to prevent upwards dislodgment therefrom of a clip, and means mounting said bar so that it can be displaced to permit upwards removal of a clip from the rail.

12 Claims, 10 Drawing Figures

Figure 7:
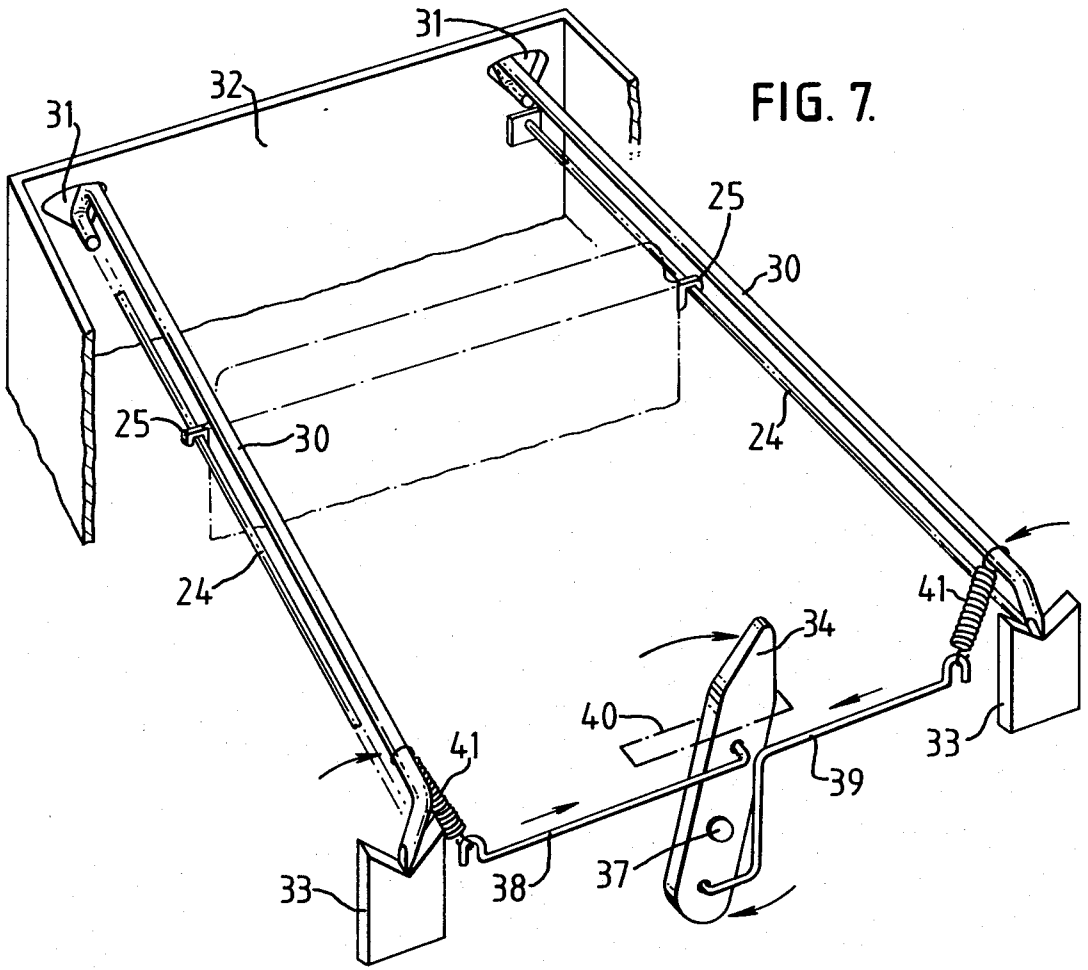

FIG. 1.
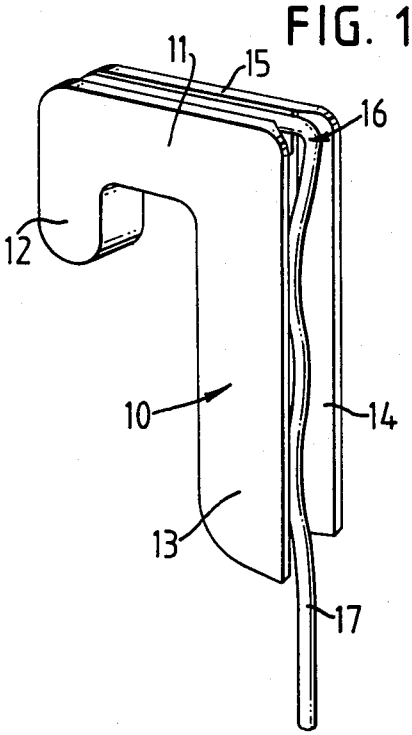
FIG. 3.
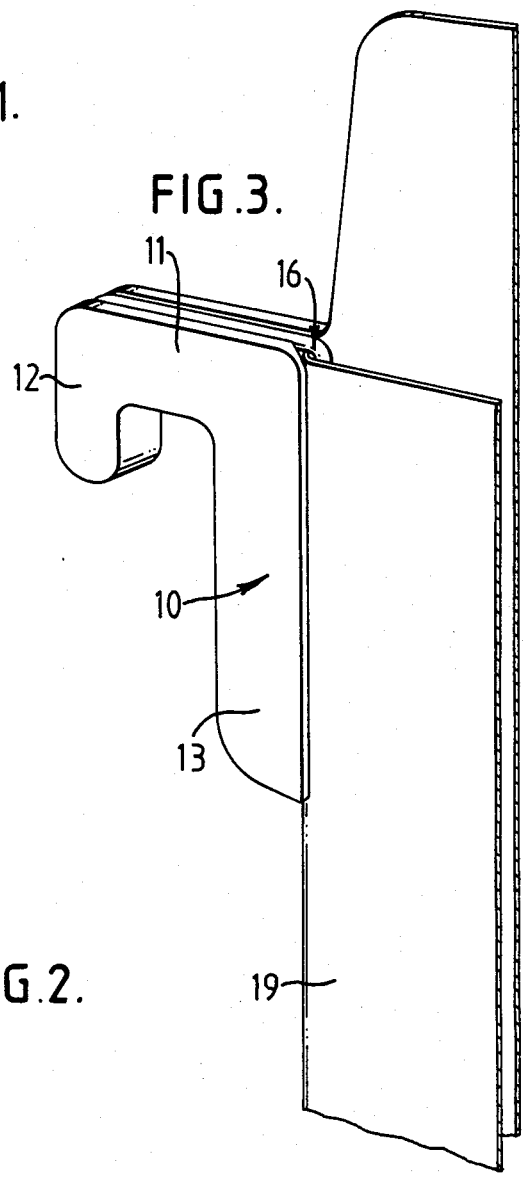
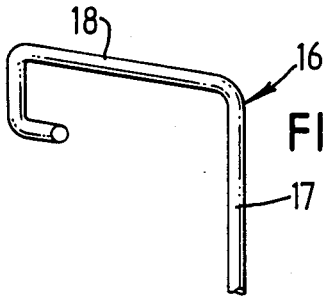
FIG. 2.

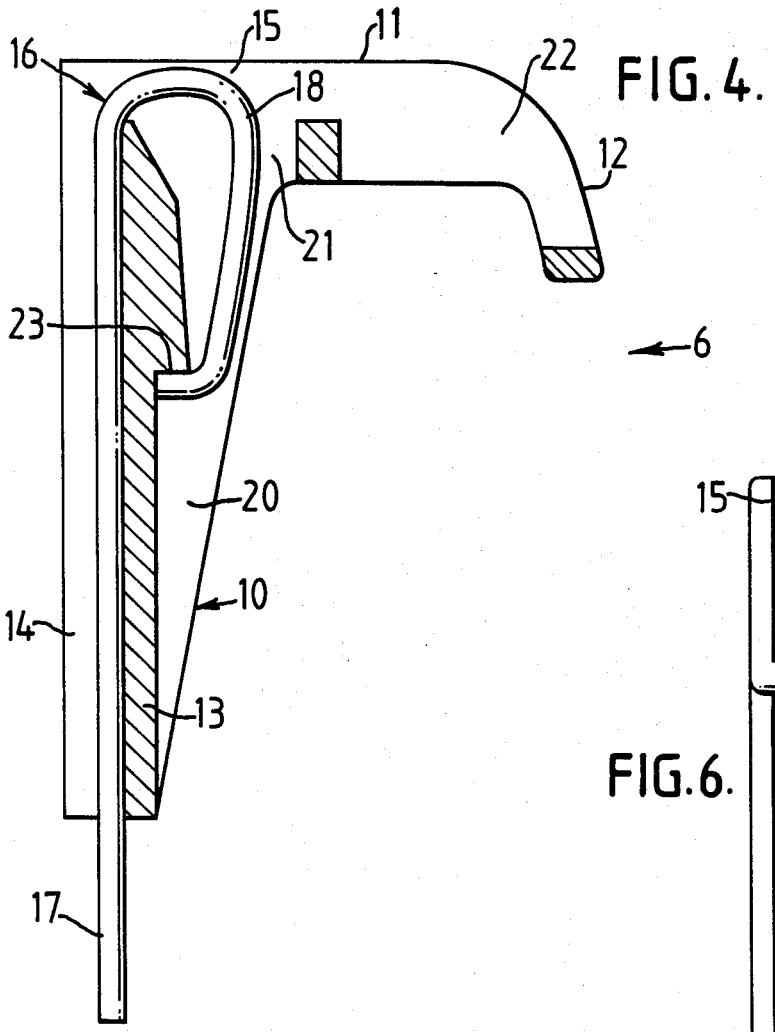
FIG. 4.
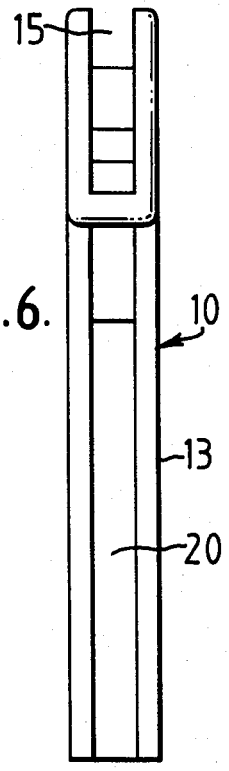
FIG. 6.
FIG. 5.
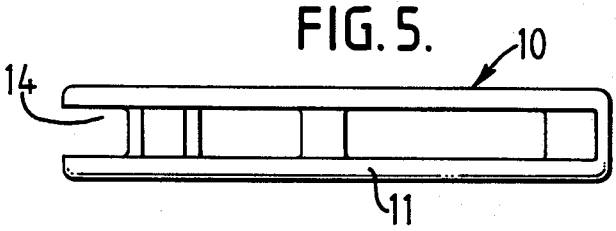

SUSPENSION FILING MEANS

DESCRIPTION

This invention is concerned with suspension filing means. It is particularly, but not exclusively, concerned with clips for use in suspension filing.

So-called floppy discs for use in computers are commonly supplied in open-topped envelopes, the discs projecting from the open tops from which they are removed for use. Various systems are in use for filing floppy discs for retrieval so that they can be kept in a desired order and a required disc can be removed from its envelope and replaced therein after use. It is an object of the present invention to provide inexpensive and simple means by which open-topped envelopes can be filed in a suspension filing system.

According to the invention, a suspension clip comprises a hook member of U-shape having a transverse part from which extend two arms, one of which has on its outside a longitudinally extending groove, and a resiliently deflectable prong which is anchored at or adjacent said transverse part and extends along said groove. The prong, when inserted inside an upper corner of an open-topped envelope, presses the upper part of the side edge of the envelope into the aforesaid groove so that the clip is held in position on the envelope, projecting sideways therefrom. When two clips have been thus attached to the two upper corners of an envelope, they provide two hook members by which the envelope can be suspended from two parallel rails of a suspension filing system.

Preferably, the arm having said groove is substantially longer than the other arm. Thereby, firm positioning of the clip results. Preferably, the prong extends beyond the end of the arm having said groove. Thus, insertion of the prong into an envelope is facilitated.

It is preferred that, at least when the clip is not in use, the prong extends within said groove. Accordingly, when the clip is in use, the prong takes up minimum space in the envelope.

Preferably, the hook member comprises a moulded body (e.g. of plastics material) and the prong comprises a spring wire (e.g. of metal). Preferably, also, the prong has a hooked arm which anchors it in said body. The hooked arm may extend within a groove outside said transverse part of the hook member and have an end portion which engages a part on said body to anchor the prong.

To minimise the space taken up on the rails of the suspension filing system, the hook member is preferably flat.

Envelopes containing floppy discs are light in weight and lifting discs tends to dislodge envelopes and clips. To prevent unintended dislodgment of clips and their attached envelopes or other articles, they may be provided a suspension filing system for use with clips as hereinbefore set out comprising at least one rail for engagement by a clip, a retaining bar disposed above the level of and adjacent to and substantially parallel to said rail to prevent upwards dislodgment therefrom of a clip, and means mounting said bar so that it can be displaced to permit upwards removal of a clip from the rail.

Usually, there will be two rails and two retaining bars disposed parallel to one another and preferably means are provided interconnecting the bars for simultaneous displacement.

The bar or each bar preferably has cranked ends, means being provided pivotally mounting said cranked ends. In the usual case of two such bars with cranked ends, it is preferred that interconnecting means as aforesaid are provided comprising an operating lever at a position between the bars, means pivotally mounting said lever, links pivotally connected to said lever at positions spaced in opposite directions from its pivot axis, and spring members connecting said links to said bars at positions spaced from the pivot axes thereof, the connections between the links and the spring members being disposed at a level below that of the bar pivot axes and being simultaneously movable between positions spaced on opposite sides of vertical planes containing the bar pivot axes by pivoting said lever to and fro.

Figure 8:
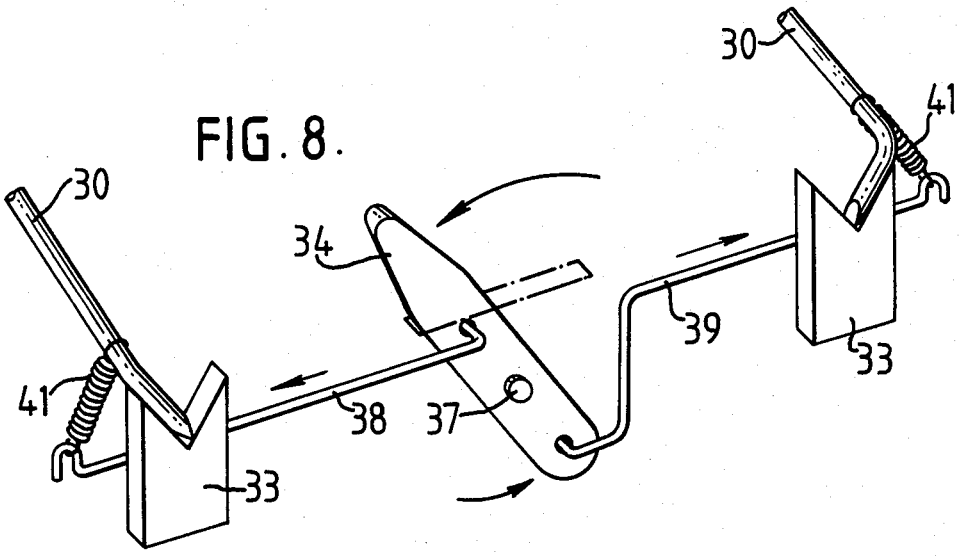
Figure 9:
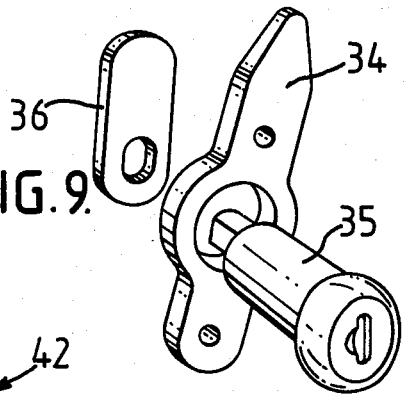
Figure 10:
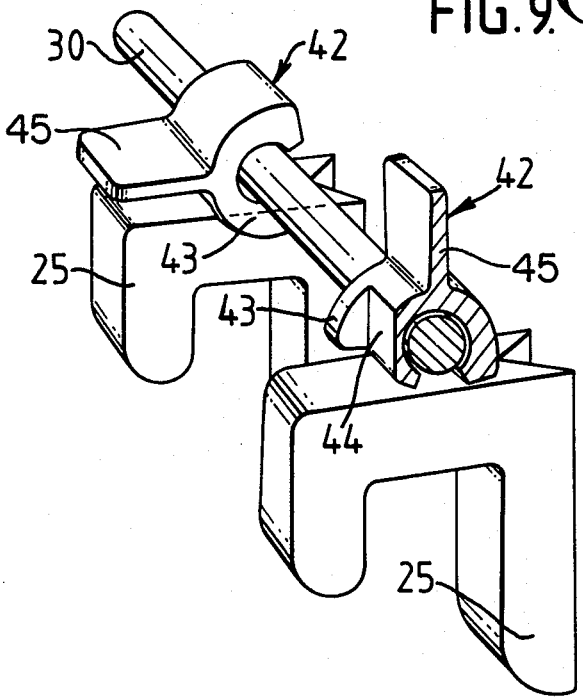

The following is a description, by way of example, of embodiments of the invention, reference being made to the accompanying drawings, in which:

FIG. 1 is a perspective view of one embodiment of a suspension clip in accordance with the invention, FIG. 2 is a partial view of the spring wire used in the clip of FIG. 1, FIG. 3 is a perspective view of the clip of FIG. 1 in position on an envelope, FIG. 4 is a sectional view of another embodiment of clip, FIG. 5 is a plan view of the hook member alone of the clip of FIG. 4, FIG. 6 is a view of the hook member alone in the direction of arrow 6 in FIG. 4, FIG. 7 is a perspective view of an embodiment of a suspension filing system in accordance with the invention in a "closed" position, FIG. 8 is a partial view of the embodiment of FIG. 7 in an "open" position, FIG. 9 is an exploded view of parts of the embodiment of FIG. 7, and FIG. 10 is a perspective view showing markers for indicating the position of particular envelopes in the filing system.

The suspension clip of FIGS. 1 to 3 comprises a flat hook member 10 in the form of a moulded body of plastics material. The hook member 10 is of U-shape, having a transverse part 11 from which extend two arms 12, 13. The arm 13 is substantially longer than the arm 12 and has on its outside a groove 14 extending for the full length of the clip. The groove 14 merges with a groove 15 which runs along the outside of the transverse part 11 and along the outside of the arm 12. A spring wire 16 of metal is formed to provide a resiliently deflectable prong 17 and a hooked arm 18. The wire is attached to the hook member by arranging it so that the prong 17 extends along the groove 14, and the hooked arm 18 extends within the groove 15 with an end portion thereof engaged in a hole in the base of the groove 15. Thereby, the prong is anchored to the transverse part 11. The prong extends within the groove 14 and beyond the end of the arm 13. In use, the free end of the prong 17 is inserted into an upper corner of an open-topped envelope 19 and the hook member is pulled away so that the upper part of the side of the envelope can slide between the prong and the arm 13. The hook member is then released so that the prong 17 presses the upper part of the side of the envelope into the groove 14, so that the clip is secured to the envelope. Two clips are secured to the two upper corners of an envelope so that the hook members can suspend the envelope from two parallel rails of a suspension filing system.

The suspension clip of FIGS. 4 to 6 is used in the same way as the clip of FIGS. 1 to 3. It is similar in construction and the same reference numerals are used for similar parts. However, in the clip of FIGS. 4 to 6, for economy of manufacture, more cavities are provided in the hook member 10. In particular, the inside of the arm 13 has a groove 20, and the transverse part 11 and arm 12 have through holes 21 and 22 extending from the groove 15.

The hooked arm 18 is shaped to extend down through the hole 21 and has an end portion which engages against a step 23 in the base of the groove 20 so as to anchor the prong to the transverse part 11.

In another embodiment (not illustrated) the prong is anchored by an end moulded into the hook member.

The suspension filing system of FIGS. 7 to 10 has parallel supporting rails 24 for engagement by suspension clips 25, which may be of any of the forms hereinbefore described, when attached to the upper corners of envelopes. The rails are fixed in a containing box for the system. Two parallel retaining bars 30 have cranked ends. The cranked rear ends of the bars are bent over to provide short portions parallel with the main lengths of the bars, which portions bear against the bottoms of inverted generally triangular holes 31 in a rear wall 32 of the containing box. The cranked forward ends of the bars are flattened into V-sections to provide edges which engage the bottoms of V recesses in blocks 33 moulded inside a front wall of the box. Thus, the bars are pivotally supported by the box so that their main lengths can be rocked through segments of arcs outwards and inwards by torsional forces transmitted through the bars from near their forward ends. The flattened forward ends are retained in the V recesses in the blocks between the front wall of the box and ledges (not shown) moulded on the blocks at the rear of the recesses, thus preventing the bars from being displaced longitudinally. A single central operating lever 34 is pivoted at 37 inside the front wall of the box by a pivot pin 35 having its inner end engaging in a hole in a plate 36 behind the lever. The pin 35 is provided by a conventional barrel lock for a hinged lid (not shown) of the box. Two links 38, 39 have cranked inner ends pivotally connected to the lever 34 at positions spaced on opposite sides of the pivot 37. The lever protrudes through a slot 40 in the top of the front wall of the box, which limits the movement of the lever. Upwards movement of the links is prevented by superposed ledges moulded inside the front wall of the box. The outer end of each link 38, 39 is hooked into one end of a helical spring 41. The other ends of the springs are attached to the bars 30 at positions on their main lengths. Thus, movement of the lever 34 causes the bars to move outwards for opening (into the open position of FIG. 8) and inwards for closing (into the closed position of FIG. 7). The ends of the springs attached to the links pass just beneath the pivot axes of the bars 30, so that the mechanism is a dual action (operating both bars simultaneously in opposite directions) over-toggle mechanism.

When a lid of the box is closed the lever 34 is covered. Preferably, a protrusion is provided on the lid, which protrusion will engage the top of the lever and prevent closing of the lid if the lever is in the open position but which will otherwise permit the lid to close. In the closed position of the bars (FIG. 7), they are each disposed above the level of and adjacent to and substantially parallel to a rail 24, thereby preventing upwards dislodgment of clips and envelopes carried thereby from the rails 24. In the open position of the bars (FIG. 8), they lie in vertical planes spaced outside of vertical planes through the rails 24, so that envelopes and the clips attached thereto can be lifted up and removed from the system or lowered and inserted into the system.

The above arrangement is particularly useful where the receptacles are open topped envelopes with hooks at the top corners and the articles to be filed are so-called floppy discs with their covers, but may be used for other articles.

In another embodiment, the bars are provided by the legs of a generally U-shaped member, which legs are pivoted to the box at their ends distant from the cross-part of the U so that said member is in a closed position when horizontal and in an open position when swung up.

FIG. 10 shows sliding markers 42 (one in section) which are slidably and rotatably mounted on a retaining bar 30. At each end of each marker is a lug 43, the lugs of each marker being separated by a flat 44. Each marker has a tab 45 for manipulation and is made of resilient plastics so that it can be sprung on to and off a bar. It is also so balanced that it tends to pivot into a position with its lugs on either side of a clip, being located in this position by engagement of the flat with the clip. Thus, the marker indicates a particular envelope and the marker will accompany the envelope if the latter is slid with its clips along the rails. When desired, the marker can be rotated by its tab so that the lugs move clear of the clip and the marker can then be slid along the bar to indicate another envelope.

I claim:

1. A suspension clip comprising a hook member in the form of a molded body of U-shape having a transverse part and two arms extending from said part, which transverse part and arms define a space having a side for passage of a supporting rail, one of which arms has on its outside a longitudinally extending narrow groove, a resiliently deflectable narrow prong of spring wire disposed clear of said side of said space and extending along said groove, and means anchoring said prong at or adjacent said transverse part.

2. A clip according to claim 1 wherein the arm having said groove is substantially longer than the other arm.

3. A clip according to claim 2 wherein the prong extends beyond the end of the arm having said groove.

4. A clip according to claim 3 wherein, at least when the clip is not in use, the prong extends within said groove.

5. A clip according to claim 1 wherein said body is made of a plastics material and said wire is made of metal.

6. A clip according to claim 1 wherein said prong has a hooked arm which anchors it in said body.

7. A clip according to claim 6 wherein said hooked arm extends within a groove outside said transverse part of the hook member and has an end portion which engages a part on said body to anchor the prong.

8. A clip according to claim 1 wherein said hook member is flat.

9. A suspension filing system for use with clips according to claim 1 comprising two parallel rails for engagement by clips, two parallel retaining bars disposed above the level of and adjacent to and substantially parallel to said rails to prevent upwards dislodgement therefrom of clips, means mounting said bars so that they can be displaced to permit upwards removal of clips from the rails and means interconnecting said bars for simultaneous displacement.

10. A suspension filing system according to claim 9 wherein said bar has cranked ends and means are provided pivotally mounting said cranked ends.

11. A suspension filing system according to claim 9 wherein said interconnecting means comprises an operating lever at a position between the bars, means pivotally mounting said lever, links pivotally connected to said lever at positions spaced in opposite directions from its pivot axis, and spring members connecting said links to said bars at positions spaced from the pivot axes thereof, the connections between the links and the spring members being disposed at a level below that of the bar pivot axes and being simultaneously movable between positions spaced on opposite sides of vertical planes containing the bar pivot axes by pivoting said lever to and fro.

12. A suspension filing system according to claim 9 wherein a marker is provided slidably and rotatably mounted on said bar, said marker having lugs engageable and disengageable with opposite sides of a clip on the bar and means for locating the marker in an engaged position.

* * * * *